US005564700A

United States Patent [19]

Celona

[11] Patent Number: 5,564,700

[45] Date of Patent: Oct. 15, 1996

[54] PROPORTIONAL PAYOUT METHOD FOR PROGRESSIVE LINKED GAMING MACHINES

[75] Inventor: Anthony P. Celona, Hammonton, N.J.

[73] Assignee: Trump Taj Mahal Associates, Atlantic City, N.J.

[21] Appl. No.: 387,101

[22] Filed: Feb. 10, 1995

[51] Int. Cl.[6] ..... A63F 9/24

[52] U.S. Cl. ..... 463/27; 463/20; 463/42

[58] Field of Search ..... 273/138 A, 142 R, 273/143 R, 138 R, 85 CP, 85 G, 439

[56] References Cited

U.S. PATENT DOCUMENTS

| | | | |
|---|---|---|---|
| 3,269,503 | 12/1964 | Foster . | |
| 4,636,951 | 1/1987 | Harlick | 364/412 |
| 4,805,907 | 2/1989 | Hagiwara | 273/138 A |
| 4,837,728 | 6/1989 | Barrie et al. | 364/412 |
| 4,964,638 | 10/1990 | Ishida | 273/138 A |
| 5,048,833 | 9/1991 | Lamle | 273/138 A |
| 5,078,405 | 1/1992 | Jones et al. | 273/85 CP |
| 5,116,055 | 5/1992 | Tracy | 273/138 A |
| 5,249,800 | 10/1993 | Hilgendarf et al. | 273/85 CP |
| 5,275,400 | 1/1994 | Weingardt et al. | 273/85 CP |
| 5,280,909 | 1/1994 | Tracy | 273/138 A |
| 5,286,023 | 2/1994 | Wood | 273/138 A |
| 5,344,144 | 9/1994 | Canon | 273/138 A |
| 5,417,430 | 5/1995 | Breeding | 273/292 |

*Primary Examiner*—Jessica J. Harrison
*Assistant Examiner*—James Schaaf
*Attorney, Agent, or Firm*—Vorys, Sater, Seymour & Pease

[57] ABSTRACT

A payout method for a group of linked gaming machines that provide a progressive jackpot pays a proportion of the jackpot to eligible players at each linked machine. Data from each of a group of linked slot machines is sent to a central controller which determines the value of the progressive jackpot by accumulating a predetermined fraction of the money bet at each linked machine. When a progressive jackpot-winning outcome occurs at one of the linked machines, the winning machine signals the controller which then announces the win. The eligibility of the players to share in the progressive jackpot may be conditioned upon placing a maximum bet at the gaming machine and initiating play at the gaming machine within a predetermined time interval before the progressive jackpot-winning outcome occurs.

44 Claims, 3 Drawing Sheets

PROPORTIONAL PAYOUT METHOD FOR PROGRESSIVE LINKED GAMING MACHINES

BACKGROUND OF THE INVENTION

1. Field of the Invention

This invention relates to progressive linked gaming machines and more particularly to a proportional payout method for progressive linked gaming machines and gaming systems to implement a proportional payout method.

2. Brief Description of the Prior Art

Gaming systems in which a group of gaming machines are linked to provide players the opportunity to win a relatively large progressive jackpot in addition to their winnings at an individual gaming machine have become popular in casino gaming establishments. In such systems a plurality of gaming machines, such as slot machines, poker machines, keno machines, and the like, are electronically linked to a central progressive controller which computes a progressive jackpot based on the amount of money bet at the linked machines and awards the jackpot to the player at a machine presenting the winning outcome. Typically, each of the linked gaming machines transmits data to the central progressive controller regarding the amount of money bet by the player each time he plays the machine, and the outcome of the play cycle. The central controller contains computing means which calculates a progressive jackpot by attributing a portion of the money bet at each of the linked gaming machines to a jackpot sum. Typically, the current amount of the jackpot is displayed either at the individual machines or at other displays associated with the central controller or placed throughout the casino. When the central controller receives outcome data from one of the linked gaming machines indicating that a jackpot-winning outcome has occurred, the controller signals the win and indicates to the winning player the amount of the jackpot that has been won. The jackpot may be paid by the individual gaming machine, if it has sufficient coin capacity, or by the house cashier for large jackpots.

U.S. Pat. No. 4,837,728, to Barrie et al, discloses such a multiple progressive gaming apparatus wherein a player at a linked gaming machines may be eligible for several different winning amounts depending on the particular winning outcome presented at his machine.

U.S. Pat. No. 5,116,055, to Tracy, illustrates a progressive linked gaming apparatus wherein the amount of money contributed to the progressive jackpot by each of the linked gaming machines is adjusted according to the amount of the standard bet at each of the linked machines, so that the contribution of each of the machines to the jackpot is generally equalized. The entire disclosure of this patent is incorporated herein by reference.

U.S. Pat. No. 5,280,909, to Tracy, discloses a progressive linked jackpot gaming system wherein the jackpot-winning event is generated when the total amount of the progressive jackpot reaches a secret predetermined value. The winning machine is the one responsible for the progressive Jackpot total reaching the secret predetermined value. The entire disclosure of this patent is incorporated herein by reference.

However, while such gaming systems employing linked gaming machines increase interest in slot machine gaming by providing a large jackpot which can be won by a player at one of the linked gaming machines, the fact that the jackpot is paid at only one winning machine, whereas bets at all the linked machines contribute to the total, can be a discouraging factor for players, who may feel that their chances of winning the jackpot are very remote.

Accordingly, a need has continued to exist for a payout method for linked progressive gaming machines which increases the betting interest of all players at the group of linked machines.

SUMMARY OF THE INVENTION

The discouraging all-or-nothing payout procedure of the prior art linked progressive gaming machines is modified and improved by the method of this invention.

According to the invention, the proceeds of a jackpot win among players gaming at a group of progressive linked gaming machines is paid proportionately to all the players at the group of linked machines.

The invention also comprises an apparatus comprising a plurality of gaming machines linked to an electronic controller by data carrying means. Betting data representing the amount of money bet is sent from each of a group of linked slot machines to a central progressive controller which determines the value of the progressive jackpot by adding to the jackpot a predetermined fraction of the money bet at each linked machine. The jackpot may be started with an initial seed contribution from the house to encourage initial interest in playing the linked machines. When a jackpot-winning outcome is achieved at one of the linked machines, the controller detects the win and identifies the winning machine, and then arranges to pay to the players at each of the linked machines a predetermined proportion of the jackpot sum.

Accordingly, it is an object of the invention to provide a method for increasing the interest in gaming at linked progressive gaming machines.

A further object is to provide a method for distributing the payout from a linked progressive jackpot proportionally among the players at the linked gaming machines.

A further object is to provide a system of linked gaming machines controlled by a progressive controller that distributes the progressive jackpot proportionally among the players at the linked gaming machines.

A further object is to provide a progressive controller that receives betting data from linked gaming machines, determines the amount of a progressive jackpot, detects a jackpot winning outcome at one of the linked gaming machines, and determines the eligibility of players to participate in the progressive jackpot using the amount of their bet and the time interval between their bet and the jackpot winning outcome as criteria of eligibility.

Further objects of the invention will become apparent from the description which follows.

DETAILED DESCRIPTION OF THE INVENTION AND PREFERRED EMBODIMENTS

Figure 1:
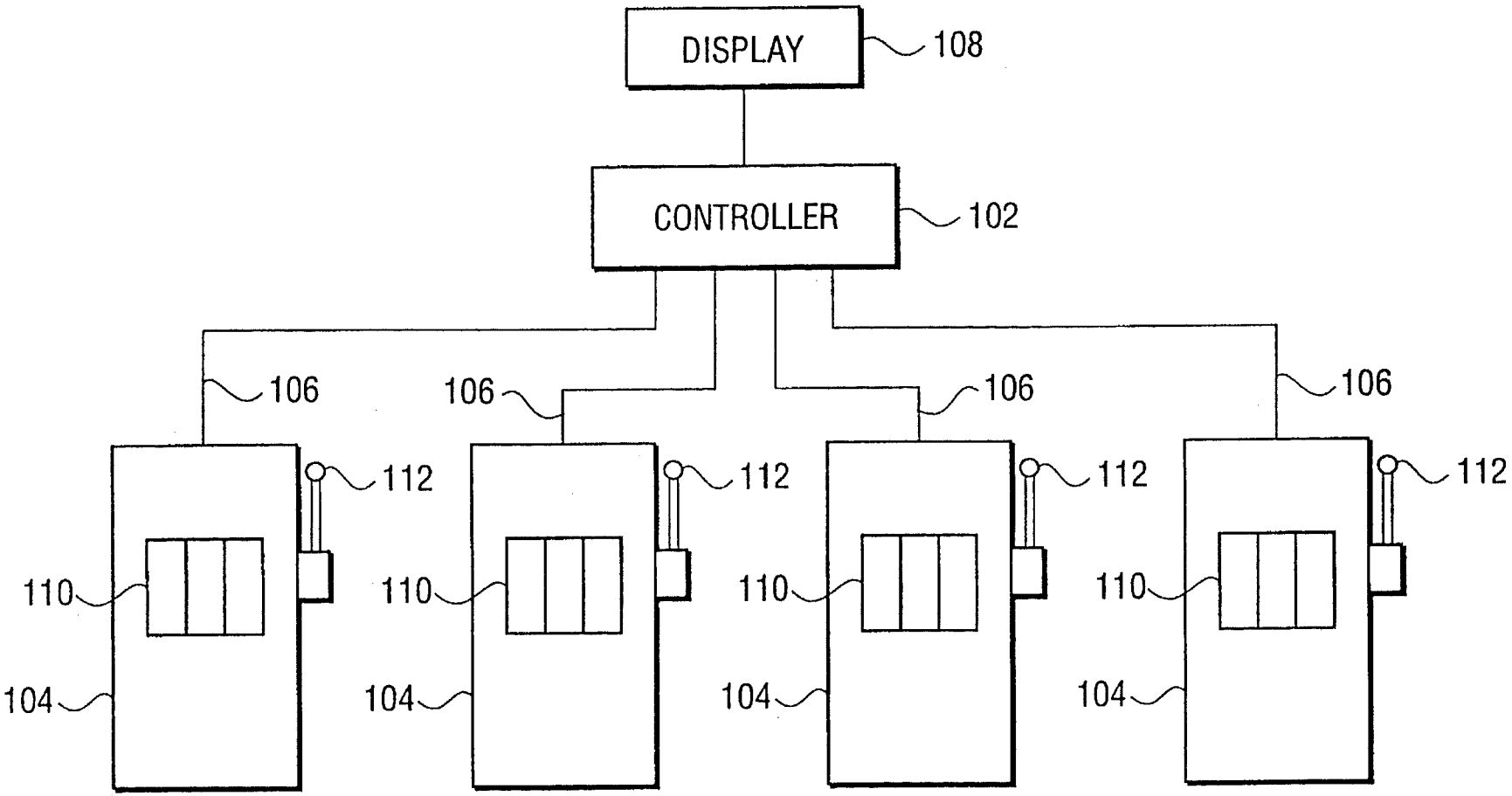
FIG. 1 illustrates an linked gaming machine system that is suitable for practicing the method of this invention.

According to the invention a number of gaming machines are linked to a central progressive controller through data links which allow the transfer of information at least from the individual gaming machines to the controller. The gaming machines are of the conventional type that accept a bet of an amount of money in the form of coins, tokens or other indicia of value before each play. The amount of the bet placed at the machine may be fixed, as when the machine accepts only a coin of a defined value, or it may be variable and controlled to some extent by the player, who may insert, e.g., one or more coins as he wishes up to a maximum number of coins for each play. When the bet may vary, the payout for a winning play at the machine is related to the amount bet, larger bets receiving proportionately greater payouts.

As each player places a bet at one of the gaming machines and initiates play, data representing the amount of the bet is transmitted to the progressive controller via the data link. The progressive controller accumulates the betting data from all the linked gaming machines and computes the amount of the progressive jackpot by adding a predetermined proportion of the amount of each bet to the progressive jackpot sum. The progressive jackpot may be seeded by an initial house contribution to assure that its value will be sufficient to attract players even immediately after a previous progressive jackpot payout. The current amount of the progressive jackpot is typically displayed on a display device under control of the progressive controller. When one of the linked gaming machines generates a progressive jackpot-winning outcome, the progressive controller detects the outcome and indicates it at least to the eligible players at the linked machines. The controller may also indicate the proportions of the progressive jackpot to be received by each player. The progressive jackpot may be divided equally among all eligible players at the linked machines, or the player at the machine that generated the progressive jackpot-winning outcome may receive a greater proportion of the jackpot. For example, the player at the progressive jackpot-winning machine may receive one-half of the progressive jackpot, while the other eligible players share the other half. If the linked machines do not contribute equally to the progressive jackpot, the proportion of the jackpot paid to each of the players may be adjusted in accordance with the contribution of each machine to the progressive jackpot sum.

In order to encourage play at the linked gaming machines, the eligibility of each player for a share of the progressive jackpot may be conditioned by requirements for a minimum bet and/or recent play. For example, a player at one of the linked gaming machines may be eligible to win the progressive jackpot only if his bet is not less than a predetermined mimimum amount. In particular, a player may be considered eligible for a share of the progressive jackpot only if he has bet the maximum amount that his machine will accept, e.g., by inserting the maximum number of coins that the machine will accept for one play. Furthermore, a player may be eligible to win the progressive jackpot only if he has initiated a play cycle at his machine within a predetermined interval, e.g., 15 seconds, before the progressive jackpot-winning outcome appears at one of the linked gaming machines. The eligibility of each player to share in the progressive jackpot is determined by the controller using data received from the gaming machines. For example, the controller may receive data representing the amount bet at each machine and the initiation of play at each machine, and determine a player's eligibility from predetermined internal standards regarding the amount of the bet required for eligibility and the interval, determined using an internal clock, between the initiation of play and the jackpot-winning outcome. Alternatively, the individual gaming machines may determine the fact that a bet not less than the predermined minimum bet has been made and the time that play is initiated and transmit that data to the controller for use in determining a player's eligibility. In any case, when eligibility is so conditioned, only those players who have placed the required minimum bet and/or initiated a play cycle within the defined time window are eligible for a share of the progressive jackpot.

FIG. 1 illustrates a group of linked progressive slot machines suitable for carrying out the payout method of this invention. Each slot machine 104 accepts an input of money or equivalent from a player before each play cycle of the machine. Betting data representing the amount of money bet is communicated to controller 102 via data links 106. The controller 102, which may comprise an appropriately programmed digital computer, computes a predetermined fraction of the amount bet at each linked machine and adds the computed amount to the jackpot total. The controller 102 may also display the current amount of the progressive jackpot on the jackpot display 108.

When a player initiates the play cycle of the machine, e.g., by pulling lever 112, as shown in FIG. 1, pushing a button, or other way of initiating play, the gaming machine mechanism proceeds to generate one of the possible random outcomes of the play cycle. The player is informed of the outcome by means of the display 110.

Each outcome is associated with a particular payout according to the conventional rules for such gaming machines. For, example, some outcomes result in the player losing his bet, while other outcomes result in certain payouts, the higher payouts generally corresponding to less likely outcomes. It is also possible to have a local jackpot payout at each machine which is awarded to the player when the machine generates a particular predetermined outcome. The progressive jackpot containing a sum determined by the betting input of all the linked machines, optionally also including an initial seed amount contributed by the house, may also be won by a player at one of the linked gaming machines when a particular predetermined jackpot-winning outcome is generated. When such a progressive jackpot-winning outcome occurs on one of the linked machines, the data indicating the win is communicated to the controller which thereupon computes the fraction of the jackpot to be paid to each of the machines according to a predetermined formula, and either commands each machine to dispense the sum won or displays it on the display to inform the players the amount of their winnings which may be collected elsewhere in the house.

According to the invention, the predetermined amount of the payout to each of the linked machines may be determined according to any plan. Typically a greater share of the jackpot payout will be distributed to the player at the machine which generates the progressive jackpot-winning outcome, while lesser shares are paid to the players of the other linked machines. For example, one-half of the jackpot may be paid to the player at the winning machine, while the remaining one-half is distributed equally among the players at the other machines. If machines contributing different proportions of the jackpot are included among the linked machines, the payout may be proportioned among the machines according to their contribution to the total amount of the jackpot.

In a further embodiment of the proportional payout method of this invention, one or more groups of linked gaming machines can be linked together to contribute to a higher progressive jackpot which is awarded to all players at the linked gaming machines who meet the eligibility criteria. In such an arrangement a player has the possibility of winning the individual group progressive jackpot or the progressive jackpot for the linked groups.

Figure 2:
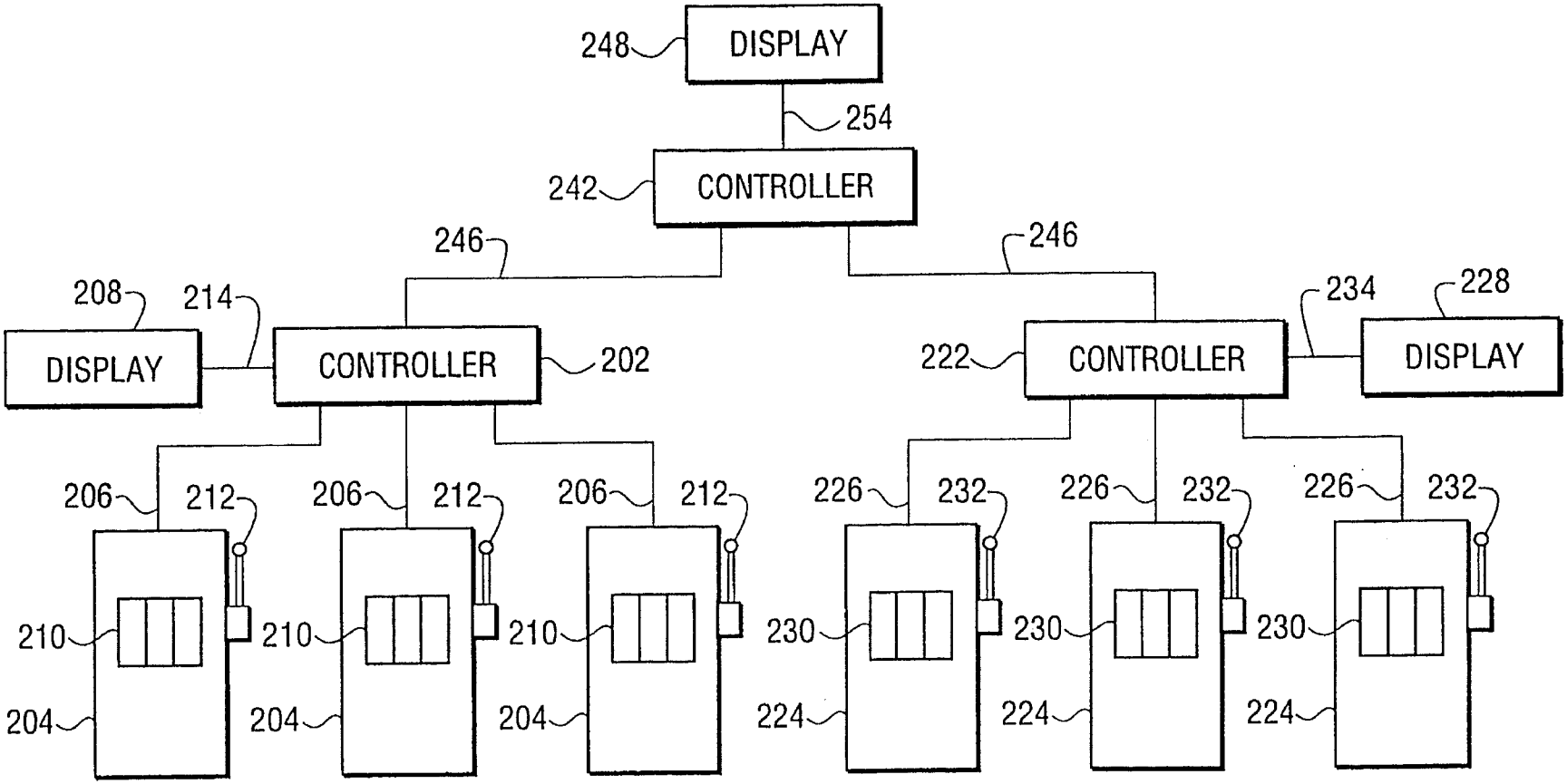
FIG. 2 illustrates a linked progressive gaming system suitable for practicing the method of the invention wherein multiple progressive jackpots are accumulated and distributed.

FIG. 2 illustrates such an arrangement wherein gaming machines are linked in groups and the groups in turn are linked at a higher level. According to this arrangement, gaming machines 204 are linked to a group controller 202 via data links 206 to constitute a first linked group. The gaming machines 204 are conventional linked machines having a machine display 210 and a play-initiating lever 212. The group controller 202 functions with respect to the linked machines 204 in the same way as described above, computing a progressive jackpot, displaying the current jackpot sum, e.g., by transmitting the sum via data link 214 to display 208, recognizing a jackpot-winning outcome and identifying players eligible to share in the jackpot. A second linked group is formed by gaming machines 224 linked to a second group controller 222 via data links 226. Each linked machine 224 is a conventional gaming machine having a play-initiating lever 232 and a display 230 that indicates the outcome of a play cycle. The group controller 222 is linked by data link 234 to display 228 which displays the current jackpot sum for the second group of linked machines. General controller 242 is linked to all the gaming machines, either via the group controllers 202 and 222 with data links 246 as shown in FIG. 2, or directly to each machine (not shown). The general controller 242 computes a general progressive jackpot and displays the current value on display 248 to which it is linked by data link 254. The payout of the progressive jackpots may be made through the individual machines or through a cashier.

It is also according to the invention to have more than two groups of linked gaming machines which may be linked to a general controller and participate in a general progressive jackpot. Furthermore, where several groups of linked gaming machines are in turn linked to higher controllers, it is also according to the invention to have multiple levels of controllers, each providing a progressive jackpot which is shared among eligible players.

Figure 3:
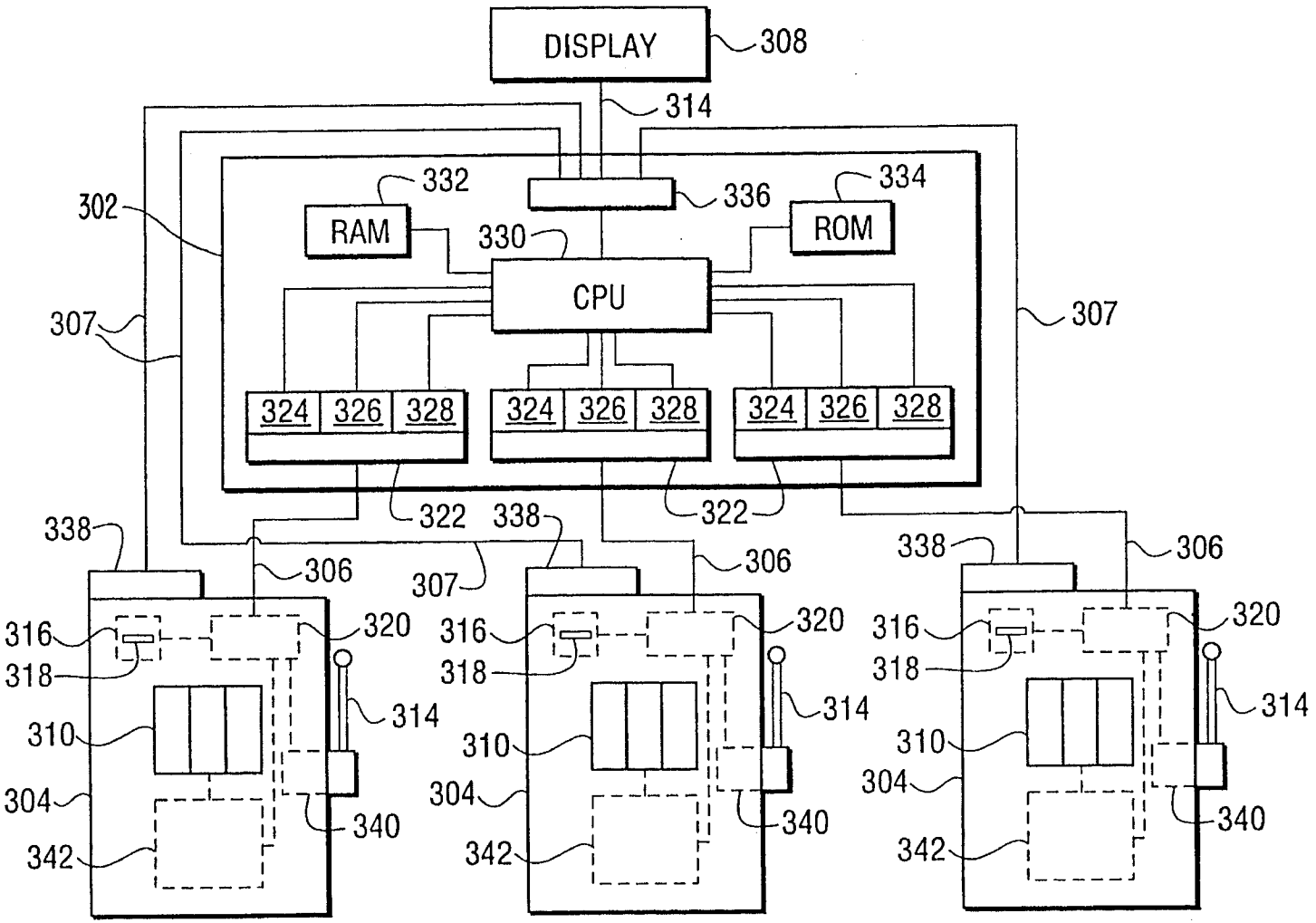
FIG. 3 illustrates an apparatus suitable for practicing a preferred embodiment of the invention wherein the eligibility of players at the linked gaming machines to participate in the progressive jackpot is conditioned by the amount of money bet at a gaming machine and the time interval between play initiation and the occurrence of a jackpot-winning outcome at one of the linked gaming machines.

FIG. 3 illustrates in more detail an apparatus according to the invention for establishing a progressive jackpot among linked gaming machines and distributing the jackpot according to eligibility rules when a jackpot-winning outcome occurs at one of the linked machines.

In the apparatus of FIG. 3 a group of linked gaming machines 304 is linked to a progressive controller 302 via data links 306. Each gaming machine 304 includes a means 316 for accepting a bet of an amount of money, e.g., by depositing one or more coins in a coin slot indicated schematically as 318. The means for accepting a bet can be any conventional apparatus that provides the usual functions of receiving a bet in a gaming machine, e.g., determining that the coins deposited are genuine and determining their value. The means 316 for accepting bets also conveys data representing the amount of the bet or the number of coins deposited to the data transmitter 320 which transmits the betting data to the central controller 302 via data link 306. The data link 306 can comprise any means of transferring information from the gaming machine to the central controller or vice versa. For example the data link may be a direct electrical connection having wires for each channel of information carried, e.g., betting data, play-initiation data, and play outcome data. Alternatively, a single wire may carry the information in a time-multiplexed data transmission scheme as is well known to those skilled in the art. The data link 306 can also be effected by optical, infra-red or radio transmissions, implemented by appropriate transmitters and receivers. Accordingly, the data transmitting means 320 can be any means of sending a data-carrying signal from the gaming machine 204 to the receiving means 322 in the progressive controller 302.

Each gaming machine 304 also contains means for initiating a play cycle, e.g., a conventional lever 314 that is pulled to start the play. Other play-initiating means may also be used, e.g., a pushbutton, touchplate, footswitch or the like, or the play may be initiated automatically by deposit of the coins or other procedures for placing a bet. The lever 314 initiates play in the illustrated embodiment of the gaming machine 304 by actuating switch 340 which in turn starts the gaming machine control unit 342. The control unit 342 may be an electronic unit that selects at random one of several possible play outcomes stored therein and displays the outcome on the gaming machine display 310. Such electronic control units with coupled displays are conventional and any such units and displays are usable in the apparatus of this invention. It is possible, however, although less preferred, that the play initiating means, e.g., lever 314, control unit 342 and display 310 be mechanical devices such as have been employed in gaming machines using rotating reels provided with indicia on their peripheries and controlled by springs, motors, clutches and the like. Whatever the internal means that perform the gaming machine functions, a signal is sent by the play initiation means when actuated by the player, e.g., via the play initiation switch 340, to data transmitter 320 which transmits the data via data link 306 to data receiver 322 in progressive controller 302. Similarly, the gaming machine control unit 342 sends a signal representing the play outcome to data transmitter 320 whereby it is transmitted to data receiver 322 in the progressive controller 302. The data sent from the gaming machine control unit 342 to the progressive controller 302 may be data indicating the actual outcome of each play cycle from which the progressive controller can identify a progressive jackpot-winning outcome, or the gaming machine controller 342 may itself discriminate among the outcomes of play and send data to the progressive controller 302 only when a progressive jackpot winning outcome occurs at the gaming machine 304.

The progressive controller 302 contains a receiver 322 for the data from each of the gaming machines 304 and registers for the incoming data, e.g., a betting data register 324, an outcome data register 326 and a play-initiation time register 328. The data receiving means 322 may be any type of receiver compatible with the data transmitted by the data transmitter 320 in gaming machine 304, as discussed above.

The progressive controller 302 also incorporates means for calculating the amount of a progressive jackpot sum from the betting data supplied by each of the linked gaming machines 304. The calculating means is shown in FIG. 3 as incorporating the elements of a general-purpose digital computer comprising a central processing unit 330 connected to random access memory (RAM) 332 and read-only memory (ROM) 334. In the illustrated embodiment the CPU receives data from the data registers 324, 326, 328 and, controlled by a program stored either in ROM 334 or RAM 332, performs the necessary calculations to compute the amount of the progressive jackpot or to determine the occurrence of a progressive jackpot-winning outcome and the eligibility of players to participate in the jackpot, as discussed more fully below. It will be understood by those skilled in the art that the functions of the computing the amount of the progressive jackpot can be performed by equivalent circuitry. For example, the data registers 324, 326 and 328 may be implemented as part of RAM 332. On the other hand, the calculating and comparison functions of the progressive controller 302 could be performed by dedicated hardware such as integrated circuits designed to perform the multiplication and addition involved in computing the progressive jackpot, and the comparison functions required to detect the occurrence of a progressive jackpot-winning outcome and the eligibility of players.

The progressive controller 302, at the beginning of a progressive jackpot cycle, e.g., after a previous jackpot has been won, establishes the initial amount of the progressive jackpot at a value set by the house. This initial value may be zero, but is commonly some non-zero value established by the house to attract players even when the jackpot is newly established. The progressive controller 302, using the betting data from each linked gaming machine 304 from the corresponding data register 324, then increments the progressive jackpot by adding thereto a fraction of the amount of money bet at each of the gaming machines 304. The current amount of the progressive jackpot is sent by data transmitter 330 via data link 314 to the progressive jackpot display 308. The progressive controller 302 may also send the current amount of the progressive jackpot via data links 307 to an individual display 332 at each gaming machine 304.

The progressive controller 302 may also compare the amount of money bet at each of the gaming machines 304 with the predetermined minimum bet required for eligibility to determine whether the player is eligible for a share of the progressive jackpot. In particular, in a preferred embodiment wherein the predetermined minimum bet is the maximum bet that a gaming machine 304 can acept for one play, the progressive controller 302 may determine whether the player at a particular gaming machine 304 has made the maximum bet that the machine can accept. Such a comparison is preferably performed by the CPU 330 using data from the betting data register 324. If the amount bet at a particular gaming machine 304 is not less than the predetermined minimum bet, e.g., the maximum bet that the machine can accept, and if a jackpot-winning outcome occurs at any of the linked gaming machines 304 within a predetermined interval after the initiation of play at the machine, the player is eligible for a share of the progressive jackpot.

A player initiates the play cycle of the gaming machine 304 by pulling the lever 312, operating switch 340 which activates the gaming machine control unit 342. The gaming machine control unit 342 performs the gaming cycle by selecting at random an outcome from among the possible outcomes of play, giving due weight to the probabilities of each possible outcome. The outcome is displayed to the player on the gaming machine display 310. The outcome generated by the gaming machine controller 342 is also sent to the data transmitter 320 and transmitted to the central controller via data link 306. The data representing the outcome of the play cycle is received by receiver 322 and stored in outcome register 326 in the progressive controller 302. The central controller 302 compares the data in outcome register 326 with an internally stored value, e.g., a value stored in read only memory (ROM) 334 or programmed in random access memory (RAM) 332 and determines whether a jackpot-winning outcome has occurred. If so, the controller may signal the win by means of the central display 308 and/or the individual machine displays 338, or by any other suitable method of informing the winning players.

When the play cycle is initiated at a gaming machine 304, the event is sent to the data transmitter 320 and transmitted to the controller 302 via the data link 306. The data is received by the receiver 322 and stored in a time register 328. The time data sent by the gaming machine may be simply an indication that the play initiating lever has been actuated, in which case the progressive controller 302 associates the event with the time provided by an internal clock. Alternatively, the gaming machine 304 may itself contain a clock that transmits the time of play initiation to the controller 302. When a jackpot-winning outcome is detected at any of the gaming machines 304 by the controller 302, the controller determines for each linked gaming machine 304 the interval between the time of play initiation and the time of the jackpot-winning outcome. The controller 302 then determines for each gaming machine 304 whether this interval is less than the predetermined interval defined for jackpot eligibility and if so, determines that the player at that machine qualifies to share in the progressive jackpot distribution.

In the apparatus illustrated in FIG. 3, the controller is shown as a general purpose digital computer having a central processing unit (CPU) 330 connected to a random access memory (RAM) 332 and a read only memory (ROM) 334. Typically the program for directing the operations of the controller 302 would be stored in the ROM 334, while the relevant data representing the current value of the progressive jackpot, the jackpot-eligibility status of each of the linked machines, and other data relevant to performing the functions of the controller would be stored in RAM 332 or in registers specifically provided for such data, as, for example, the betting data registers 324, the outcome data registers 326 and the time data registers 328 shown in FIG. 3. It will be understood that the functions of these registers could also be implemented in the RAM 332.

When a progressive jackpot-winning outcome occurs the event is ordinarily announced to the players by some perceptible signal. In the apparatus of FIG. 3, for example, an indication of a progressive jackpot-winning outcome could be made by means of the central display 308 and/or the individual gaming machine displays 338. The indication could be made by illuminating a special symbol in the display, or by causing the display to flash, or by any other method suitable for announcing the win. The win-announcing means may be activated by the progressive controller 302 through internal circuitry and/or software. When the progressive controller 302 recognizes that a progressive jackpot-winning outcome has occurred, an appropriate signal is sent, under software control, by data transmission means in the progressive controller 302 to the announcing means, e.g., through the data transmitter 336 if the announcement is to be made through the displays 308 or 338. Alternatively, the progressive controller 302 might activate a special visible or audible signal (not shown) to announce the win. Evidently, any perceptible means of announcing the progressive jackpot win would be suitable.

The progressive jackpot displays 308 and 338 may be any conventional display means for providing information to the players and/or other patrons of the gaming establishment. For example a digital display using incandescent light bulbs, liquid crystal displays, light emitting diode displays, changeable card displays or the like may be employed. The progressive jackpot displays 308 and/or 338 will ordinarily contain means for receiving from the progressive controller 302 data representing the current value of the progressive jackpot, e.g., a register for receiving and storing the data. The displays 308 and/or 338 will also generally contain a relatively simple control means, e.g, an electronic controller, that translates the data received from the progressive controller 302 and controls the digits of the digital display. Such data receiving and digital display controlling devices are conventional and any such devices are suitable for use in the progressive jackpot display.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

I claim:

1. A method for distributing a progressive jackpot among players at progressive linked gaming machines comprising providing a plurality of gaming machines, each of said gaming machines being capable of a) accepting a bet of an amount of money from a player, b) after accepting said bet, performing a play cycle initiated by said player, and c) generating an outcome of said play cycle, said outcome being one of a plurality of possible outcomes, at least one of said outcomes being a progressive jackpot-winning outcome;

collecting betting data from said gaming machines, said betting data representing said amounts of money bet by players at each of said machines, determining from said betting data the value of a progressive jackpot, detecting the occurrence of said progressive jackpot-winning outcome at one of said gaming machines; and upon the occurrence of said progressive jackpot-winning outcome, distributing at least a portion of said progressive jackpot among a plurality of eligible players, all of whom will receive a portion of said jackpot, selected from among said players playing at said plurality of said gaming machines, said eligible players being selected independently of any of said outcomes at said plurality of said gaming machines.

2. The method of claim 1 additionally comprising identifying said gaming machine at which said progressive jackpot winning outcome occurred as a progressive jackpot-winning machine and paying to said player at said progressive jackpot-winning machine a greater proportion of said progressive jackpot than the players at the others of said gaming machines.

3. The method of claim 1 wherein a player at one of said gaming machines is eligible for a share of said progressive jackpot only if said bet made by said player is not less than a predetermined minimum bet.

4. The method of claim 3 wherein said predetermined minimum bet is a maximum bet said gaming machine can accept.

5. The method of claim 1 wherein a player at one of said gaming machines is eligible for a share of said progressive jackpot only if said player has initiated a play cycle within a predetermined interval before said progressive jackpot-winning outcome occurs.

6. The method of claim 1 wherein a player at one of said gaming machines is eligible for a share of said progressive jackpot only if said bet made by said player is not less than a predetermined minimum bet and said player has initiated a play cycle within a predetermined interval before said progressive jackpot-winning outcome occurs.

7. The method of claim 6 wherein said predetermined minimum bet is a maximum bet said gaming machine can accept.

8. The method of claim 1 wherein said betting data is collected in an electronic controller linked to said gaming machines by data-carrying links.

9. The method of claim 8 wherein said electronic controller controls a display means for displaying the amount of said progressive jackpot.

10. The method of claim 9 wherein said display means is a single display visible to at least the players at said gaming machines linked to said controller.

11. The method of claim 9 wherein said display means comprises displays at least one of said gaming machines.

12. The method of claim 8 wherein said electronic controller controls a display indicating a progressive jackpot-winning outcome at one of said gaming machines linked to said controller.

13. The method of claim 12 wherein said display is a single display visible to at least the players at said gaming machines.

14. The method of claim 12 wherein said display means comprises a display located at at least one of said gaming machines.

15. The method of claim 12 wherein said controller controls a display indicating which players are eligible for a share of said progressive jackpot.

16. The method of claim 15 wherein said display means is a single display visible to at least the players at said gaming machines.

17. The method of claim 15 wherein said display means comprises displays located at at least one of said gaming machines.

18. The method of claim 1 wherein a plurality of progressive jackpots are accumulated and distributed upon the occurrence of a progressive jackpot-winning outcome.

19. An apparatus for conducting a betting game using linked gaming machines comprising:

a plurality of gaming machines;

a progressive controller for said gaming machines, each of said gaming machines being linked to said progressive controller by a data link;

a progressive jackpot display; and means for announcing a progressive jackpot-winning outcome of play at said gaming machines;

each of said gaming machines comprising means for accepting a bet of an amount of money made by a player, means for transmitting betting data to said controller, said betting data representing said amount of said bet, play-initiating means operable by said player for initiating a play cycle of said gaming machine, means responsive to said play-initiating means for performing said play cycle and generating an outcome of said play cycle, said outcome of said play cycle being one of a plurality of possible outcomes, at least one of said possible outcomes being said progressive jackpot-winning outcome, means for indicating said outcome of said play cycle to said player at each of said gaming machines, and means for transmitting outcome data to said progressive controller, said outcome data representing at least said progressive jackpot-winning outcome;

said controller comprising means for receiving said betting data from each of said gaming machines, means for computing a progressive jackpot sum from said betting data, means for transmitting data to said progressive jackpot display, said data representing the amount of said progressive jackpot, means for receiving said outcome data from each of said gaming machines, means for recognizing said progressive jackpot-winning outcome, means for determining the eligibility of each of said players at each of said gaming machines to receive a portion of said progressive jackpot, each eligible player being certain to receive a portion of said progressive jackpot, each of said eligible players being selected independently of any of said outcomes at said plurality of said gaming machines, and means for actuating said means for announcing a progressive jackpot-winning outcome;

said progressive jackpot display comprising means for receiving said progressive jackpot sum data from said progressive controller, and means for visibly displaying said progressive jackpot sum.

20. The apparatus of claim 19 wherein said means for determining the eligibility of a player to receive a portion of said progressive jackpot comprises means in said progressive controller for comparing said amount of said bet with a predetermined minimum bet amount, and means in said progressive controller for determining that said player is eligible to receive a portion of said progressive jackpot if said amount of said bet made by said player is not less than said predetermined minimum bet amount.

21. The apparatus of claim 20 wherein said predetermined minimum bet amount is a maximum bet said gaming machine can accept.

22. The apparatus of claim 19 wherein said means for determining the eligibility of a player to receive a portion of said progressive jackpot comprises means in said gaming machine for transmitting play initiation data to said controller, said data signifying the time that said player has initiated a play cycle of said gaming machine, means in said progressive controller for receiving said play initiation data and comparing said time of play initiation with the time at which said progressive jackpot-winning outcome is generated by one of said linked gaming machines to define a critical time interval between said play initiation and said generation of said progressive jackpot-winning outcome, and means in said progressive controller for comparing said critical time interval with a predetermined time interval and determining that said player is eligible to receive a portion of said jackpot if said critical time interval is not greater than said predetermined time interval.

23. The apparatus of claim 19 wherein said means for determining the eligibility of a player to receive a portion of said progressive jackpot comprises means in said progressive controller for comparing said amount of said bet with a predetermined minimum bet amount;

means in said gaming machine for transmitting play initiation data to said progressive controller, said data signifying the time that said player has initiated a play cycle of said gaming machine, means in said progressive controller for receiving said play initiation data and comparing said time of play initiation with said time that a progressive jackpot winning outcome is generated by one of said linked gaming machines to define a critical time interval between said play initiation and said generation of said jackpot-winning outcome, means in said progressive controller for comparing said critical time interval with a predetermined time interval, and means in said progressive controller for determining that a player is eligible to receive a portion of said progressive jackpot if said amount of said bet made by said player is not less than said predetermined minimum bet amount and said critical time interval is not greater than said predetermined time interval.

24. The apparatus of claim 23 wherein said predetermined minimum bet amount is a maximum bet said gaming machine can accept.

25. The apparatus of claim 19 wherein said progressive controller comprises a digital computer programmed to receive said betting data, compute said jackpot sum, transmit data representing said jackpot sum to said jackpot display, receive said outcome data, recognize said progressive jackpot-winning outcome, determine the eligibility of said player to receive a portion of said progressive jackpot, and actuate said means for announcing a winning outcome.

26. The apparatus of claim 25 wherein said digital computer is programmed to determine the eligibility of said player to receive a portion of said progressive jackpot by comparing said amount of said bet with a predetermined minimum bet amount and determining that said player is eligible to receive a portion of said progressive jackpot if said amount of said bet is not less than said minimum bet amount.

27. The apparatus of claim 26 wherein said predetermined minimum bet amount is a maximum bet said gaming machine can accept.

28. The apparatus of claim 25 wherein said digital computer is programmed to determine the eligibility of said player to receive a portion of said progressive jackpot by receiving said play initiation data and comparing said time of play initiation with a time at which a progressive jackpot-winning outcome is generated by one of said linked gaming machines to define a critical time interval between said play initiation and said generation of said progressive jackpot-winning outcome, comparing said critical time interval with a predetermined time interval, and determining that said player is eligible to receive a portion of said jackpot if said critical time interval is not greater than said predetermined time interval.

29. The apparatus of claim 25 wherein said digital computer is programmed to determine the eligibility of said player to receive a portion of said progressive jackpot by comparing said amount of said bet with a predetermined minimum bet amount, receiving said play initiation data and comparing said time of play initiation with a time at which a progressive jackpot-winning outcome is generated by one of said linked gaming machines to define a critical time interval between said play initiation and said generation of said progressive jackpot-winning outcome, comparing said critical time interval with a predetermined time interval, and determining that said player is eligible to receive a portion of said jackpot if said amount of said bet is not less than said minimum bet amount and said critical time interval is not greater than said predetermined time interval.

30. The apparatus of claim 29 wherein said predetermined minimum bet amount is a maximum bet said gaming machine can accept.

31. A progressive controller for a plurality of linked gaming machines comprising means for receiving betting data from each of a plurality of gaming machines, said betting data representing an amount of money bet by players at said gaming machines, means for computing a jackpot sum from said betting data, means for transmitting data representing said jackpot sum to a jackpot display, means for receiving outcome data from each of said gaming machines, said outcome data representing an outcome of a play cycle of one of said gaming machines, means for recognizing a progressive jackpot-winning outcome, means for determining eligibility of each of said players at each of said gaming machines to receive a share of said progressive jackpot, each eligible player being certain to receive a portion of said progressive jackpot, each of said eligible players being selected independently of any of said outcomes at said plurality of said gaming machines, and means for actuating means for announcing said progressive jackpot-winning outcome.

32. The controller of claim 31 additionally comprising means for actuating means for indicating players eligible to receive said share of said progressive jackpot.

33. The controller of claim 31 wherein said means for determining the eligibility of a player to receive a portion of said progressive jackpot comprises means in said progressive controller for comparing said amount of said bet with a predetermined minimum bet amount, and means in said progressive controller for determining that said player is eligible to receive a portion of said progressive jackpot if said amount of said bet made by said player is not less than said predetermined minimum bet amount.

34. The controller of claim 33 wherein said predetermined minimum bet amount is a maximum bet said gaming machine can accept.

35. The controller of claim 31 wherein said means for determining the eligibility of a player to receive a portion of said progressive jackpot comprises means in said gaming machine for transmitting play initiation data to said controller, said data signifying the time that said player has initiated a play cycle of said gaming machine, means in said progressive controller for receiving said play initiation data and comparing said time of play initiation with the time at which a progressive jackpot-winning outcome is generated by one of said linked gaming machines to define a critical time interval between said play initiation and said generation of said progressive jackpot-winning outcome, and means in said progressive controller for comparing said critical time interval with a predetermined time interval and determining that said player is eligible to receive a portion of said jackpot if said critical time interval is not greater than said predetermined time interval.

36. The controller of claim 31 wherein said means for determining the eligibility of a player to receive a portion of said progressive jackpot comprises means in said progressive controller for comparing said amount of said bet with a predetermined minimum bet amount;

means in said gaming machine for transmitting play initiation data to said progressive controller, said data signifying the time that said player has initiated a play cycle of said gaming machine, means in said progressive controller for receiving said play initiation data and comparing said time of play initiation with a time that a progressive jackpot winning outcome is generated by one of said linked gaming machines to define a critical time interval between said play initiation and said generation of said jackpot-winning outcome, means in said progressive controller for comparing said critical time interval with a predetermined time interval, and means in said progressive controller for determining that a player is eligible to receive a portion of said progressive jackpot if said amount of said bet made by said player is not less than said predetermined minimum bet amount and said critical time interval is not greater than said predetermined time interval.

37. The controller of claim 36 wherein said predetermined minimum bet amount is a maximum bet said gaming machine can accept.

38. The controller of claim 31 comprising a digital computer programmed to receive said betting data, compute said progressive jackpot sum, transmit data representing said progressive jackpot sum to said progressive jackpot display, receive said outcome data, recognize said progressive jackpot-winning outcome, determine the eligibility of said players to receive a portion of said progressive jackpot, and actuate said means for announcing a winning outcome.

39. The controller of claim 38 wherein said digital computer is additionally programmed to actuate means for indicating players eligible to receive said share of said progressive jackpot.

40. The controller of claim 38 wherein said digital computer is programmed to determine the eligibility of said player to receive a portion of said progressive jackpot by comparing said amount of said bet with a predetermined minimum bet amount and determining that said player is eligible to receive a portion of said progressive jackpot if said amount of said bet is not less than said minimum bet amount.

41. The controller of claim 40 wherein said predetermined minimum bet amount is a maximum bet said gaming machine can accept.

42. The controller of claim 38 wherein said digital computer is programmed to determine the eligibility of said player to receive a portion of said progressive jackpot by receiving said play initiation data and comparing said time of play initiation with a time at which a progressive jackpot-winning outcome is generated by one of said linked gaming machines to define a critical time interval between said play initiation and said generation of said progressive jackpot-winning outcome, comparing said critical time interval with a predetermined time interval, and determining that said player is eligible to receive a portion of said jackpot if said critical time interval is not greater than said predetermined time interval.

43. The controller of claim 38 wherein said digital computer is programmed to determine the eligibility of said player to receive a portion of said progressive jackpot by comparing said amount of said bet with a predetermined minimum bet amount, receiving said play initiation data and comparing said time of play initiation with a time at which a progressive jackpot-winning outcome is generated by one of said linked gaming machines to define a critical time interval between said play initiation and said generation of said progressive jackpot-winning outcome, comparing said critical time interval with a predetermined time interval, and determining that said player is eligible to receive a portion of said jackpot if said amount of said bet is not less than said minimum bet amount and said critical time interval is not greater than said predetermined time interval.

44. The controller of claim 43 wherein said predetermined minimum bet amount is a maximum bet said gaming machine can accept.

* * * * *